US005437386A

United States Patent [19]

Von Holdt

[11] Patent Number: 5,437,386

[45] Date of Patent: Aug. 1, 1995

[54] CONTAINER WITH TAMPER-EVIDENT LID REMOVAL MEANS

[76] Inventor: John W. Von Holdt, 6864 Lexington La., Niles, Ill. 60648

[21] Appl. No.: 105,305

[22] Filed: Aug. 11, 1993

[51] Int. Cl.[6] ..... B65D 17/32; B65D 41/16

[52] U.S. Cl. ..... 220/306; 220/268; 220/354; 220/355

[58] Field of Search ..... 220/306, 307, 266, 268, 220/354, 355

[56] References Cited

U.S. PATENT DOCUMENTS

| | | | |
|---|---|---|---|
| 2,914,104 | 11/1959 | Jocelyn | 220/307 X |
| 3,566,946 | 3/1971 | MacDonald | 220/354 X |
| 4,397,404 | 8/1983 | Blanchette | 220/306 |
| 4,452,382 | 6/1984 | Von Holdt | 220/307 X |
| 4,474,305 | 10/1984 | Marco | 220/307 |
| 4,512,494 | 4/1985 | Von Holdt | 220/307 |
| 4,520,943 | 6/1985 | Nielsen | 220/281 |
| 4,524,882 | 6/1985 | Buc | 220/306 |
| 4,762,248 | 8/1988 | Uhlig | 220/307 |

*Primary Examiner*—Allan N. Shoap
*Assistant Examiner*—Vanessa Caretto
*Attorney, Agent, or Firm*—Banner & Allegretti, Ltd.

[57] ABSTRACT

A plastic container defines a sidewall closed at one end and open at the other end. A container lip is defined at the other end which comprises a pair of spaced walls surrounding the longitudinal axis of the container, to define a recess between the walls for receiving and locking a peripheral container lid portion on the container. The outer of the pair of walls defines at least one pair of spaced points of tearing weakness to permit breaking of the outer wall and outward folding of that part of the outer wall positioned between the points of tearing weakness, to provide access to the peripheral lid portion for lid removal. The container may be designed so that the lid cannot be removed without the breaking of the points of tearing weakness, to provide tamper indication to the container and lid.

10 Claims, 3 Drawing Sheets

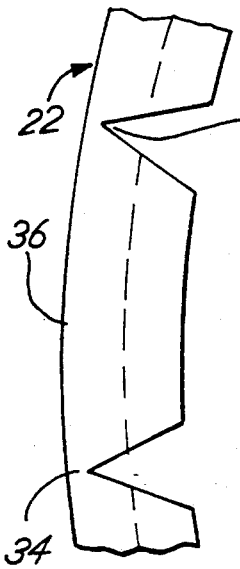
FIG. 3
FIG. 1
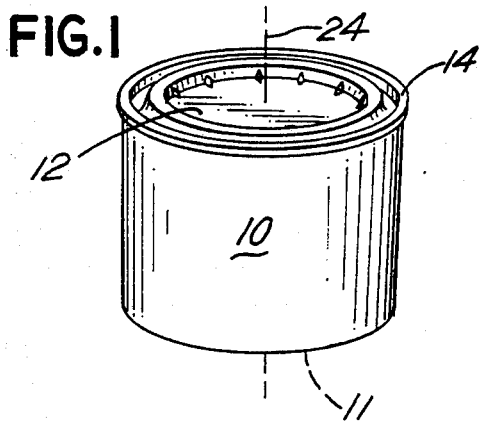
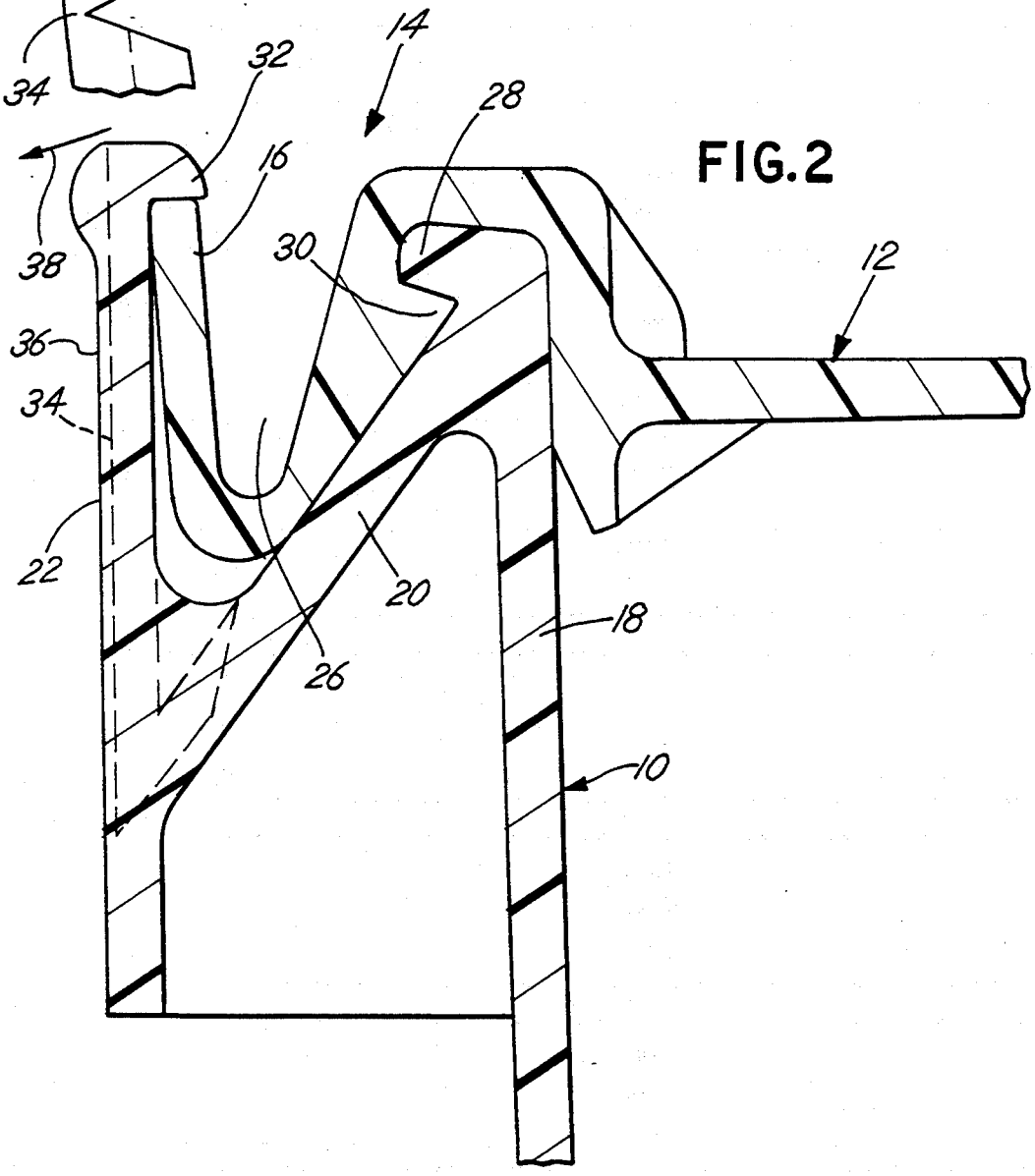
FIG. 2

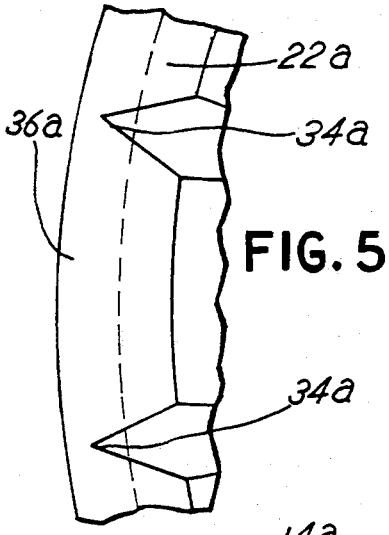
FIG. 5
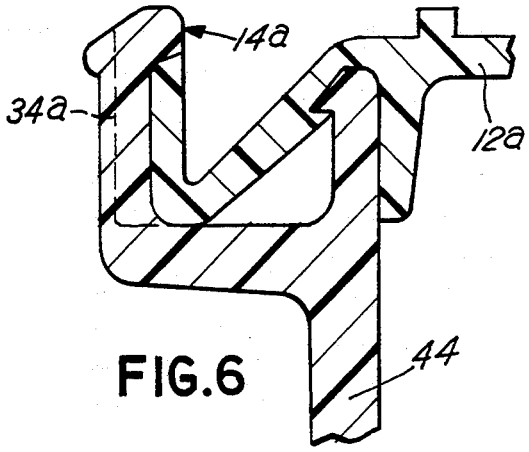
FIG.6
FIG.4
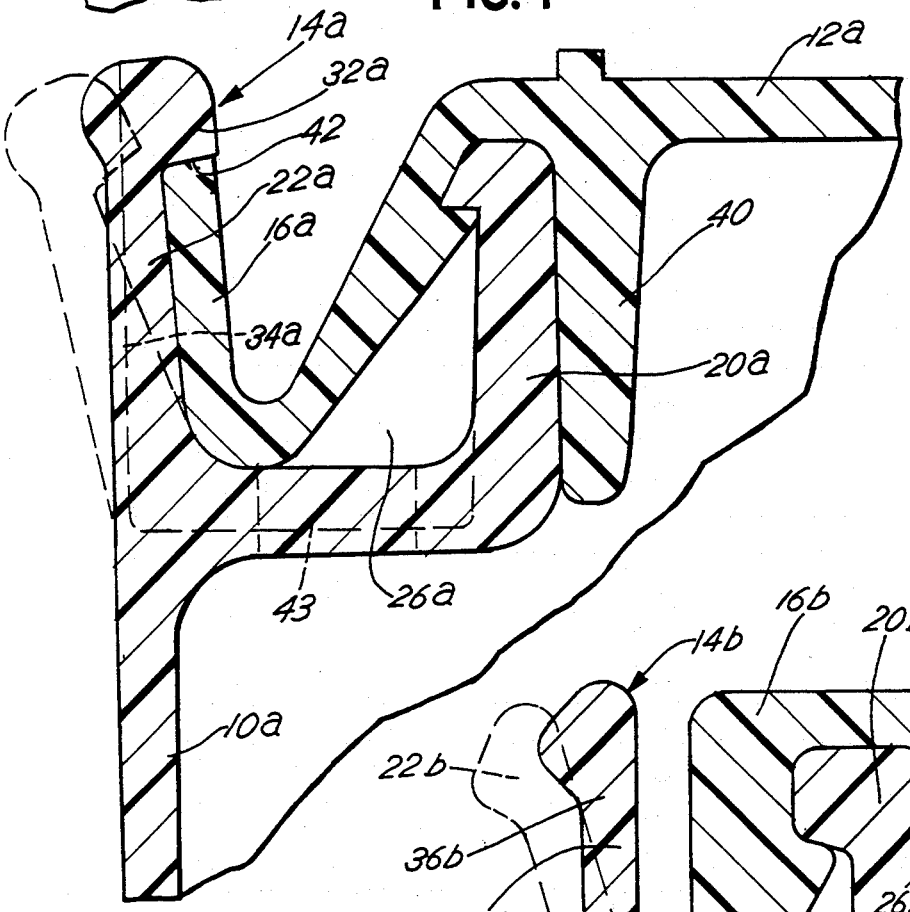
FIG.7
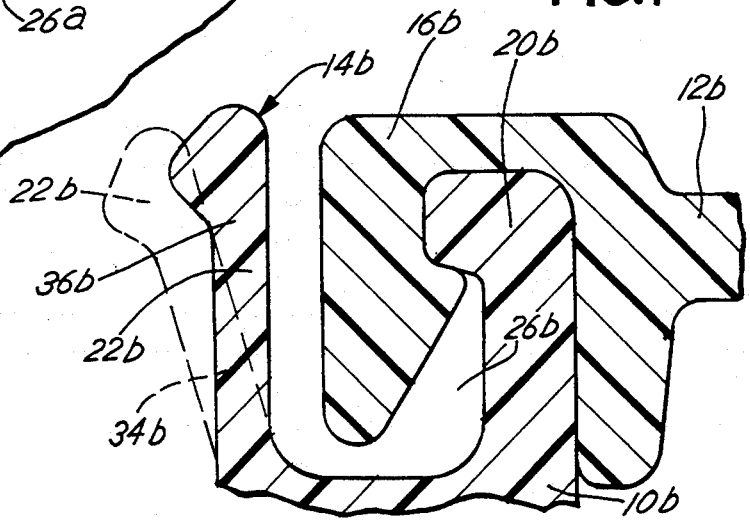

CONTAINER WITH TAMPER-EVIDENT LID REMOVAL MEANS

BACKGROUND OF THE INVENTION

There are many designs of plastic containers having typically a wide mouth and a lid closure that locks onto the lip of the container. For example see Von Holdt U.S. Pat. Nos. 4,210,258; 4,252,382; 4,512,493; 4,574,974; 4,735,337; and 4,375,948, among others.

Also, it is desirable for the lock of the lid to the container to be as strong as possible, but to be easily openable only in a way that leaves an indication that the container has been opened. To this end, various breakaway tear tabs have been used. For example, a circumferential tear tab that extends all the way around the container is shown in one of the above cited patents. Also, a container opening system entitled Super Foss has been introduced by a company from Denmark in the United States, in which a tear tab at the lip of the container breaks at one end only, and tears away from the container along with a circumferential strip. Such constructions, however, leave the separated tear tabs as litter. Also, there is a risk that small children may swallow the strips or otherwise injure themselves.

Accordingly, there is a need for a container with a strong seal for its lid, yet which is capable of opening in only one way which provides a tamper proof indication, and also includes a tear portion which does not separate from the container.

DESCRIPTION OF THE INVENTION

In this invention, a plastic container is provided which defines a sidewall and is closed at one end and open at the other end, for example in the manner of a conventional plastic paint bucket or the like. A container lip is defined at the other end of the plastic container. The container lip comprises a pair of spaced walls which surround the longitudinal axis of the container to define a recess between the walls, for receiving and locking a peripheral portion of a container lid to the container. The particular design of the spaced walls for providing this locking may vary in a variety of ways, with specific examples being shown below. Also, it is preferable for the walls and recess to define a closed loop, which may be circular, rectangular, or another shape in accordance with the cross-sectional shape of the container.

The outer of the container lip walls defines at least one pair of spaced points of tearing weakness to permit breaking of the outer wall, typically with a tear line that is substantially parallel to the longitudinal axis of the container. This permits outward folding of that part of the outer wall which is positioned between the points of tearing weakness after such tearing, to provide access to the peripheral lid portion. With such access, the lid may be removed, for example with a screw driver by prying an outer flange of the lid upwardly in a manner that is generally conventional.

Such a container thus exhibits an important tamper proof indication, provided by the torn lines of weakness, which also permit the outward folding of the outer wall part. Typically, the container may carry its lid again in resealed relation. The outwardly folded outer wall portion may be pushed back into a sealing position, which typically can provide effective sealing again for the remaining contents of the container after partial use.

In some embodiments, the spaced walls may define an acute angle to each other. The term "spaced" as used herein does not exclude a common point of connection between the two walls at one end of the walls, for example as shown in one embodiment herein.

Alternatively, the spaced walls may be substantially parallel to each other as shown in other embodiments herein.

It is also preferred for the outer of the walls to define an outwardly projecting tab between the pair of points of tearing weakness. This can be used to facilitate breaking of the outer wall and its outward folding, simply by manual pressing of the outwardly projecting tab.

The inner of the pair of spaced walls of the container adjacent the bucket lip may define outwardly projecting rib means, which typically extends circumferentially in a closed loop to provide locking attachment of a lid carried thereon. Also or alternatively, it may be desirable for the outer of the pair of spaced walls to define inwardly projecting rib means, typically in a closed loop about the circumference of the container. These may be used to provide locking attachment of a lid carried thereon. A double lock with both the inwardly and outwardly projecting rib means may be used.

Thus a container is provided having excellent sealing characteristics, being openable only by a tamper evident means so that the opening thereof is indicated. At the same time, no free tear tab is created by the opening process, to avoid the disadvantages of such a tear tab.

DESCRIPTION OF THE DRAWINGS

In the drawings, FIG. 1 is a perspective view of a bucket and lid in accordance with this invention;

FIG. 2 is an enlarged sectional view taken across the peripheral lip of one embodiment of the bucket and lid of FIG. 1;

FIG. 3 is a top plan view of a portion of the outer wall of the bucket of FIG. 2;

FIG. 4 is a sectional view of another embodiment similar to FIG. 2, showing how a portion of the outer wall can be folded outwardly to provide access for opening in a tamper-proof manner;

FIG. 5 is a top plan view of a portion of the outer wall of the bucket of FIG. 4;

FIG. 6 is an enlarged section view across the lip of another embodiment of the bucket of this invention;

FIG. 7 is an enlarged sectional view taken across the bucket lip of another embodiment;

DESCRIPTION OF SPECIFIC EMBODIMENTS

Figure 9:
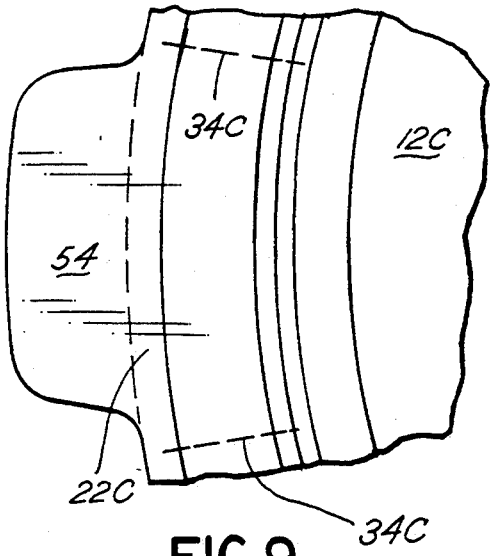
FIG. 9 is a top plan view of the bucket and lid of FIG. 8.
Figure 10:
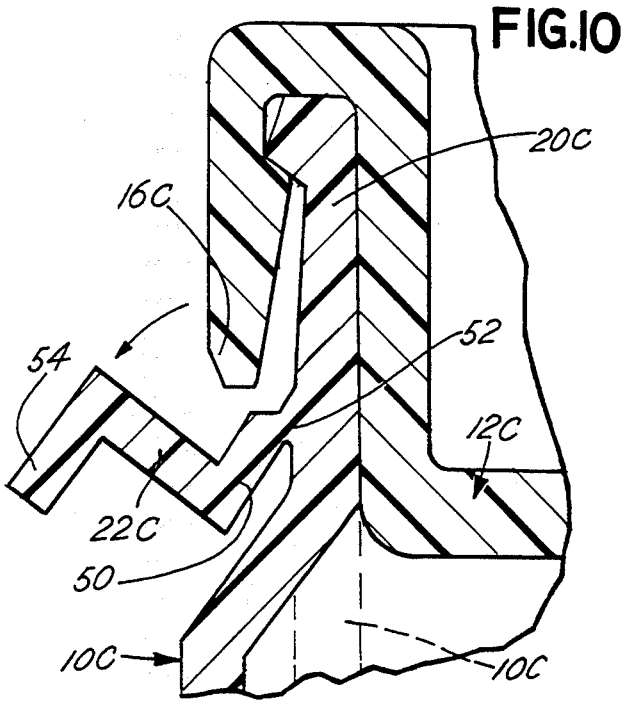
FIG. 10 is a sectional view similar to FIG. 8, showing how a portion of the outer bucket wall can be folded outwardly to remove the lid from the bucket.
Figure 8:
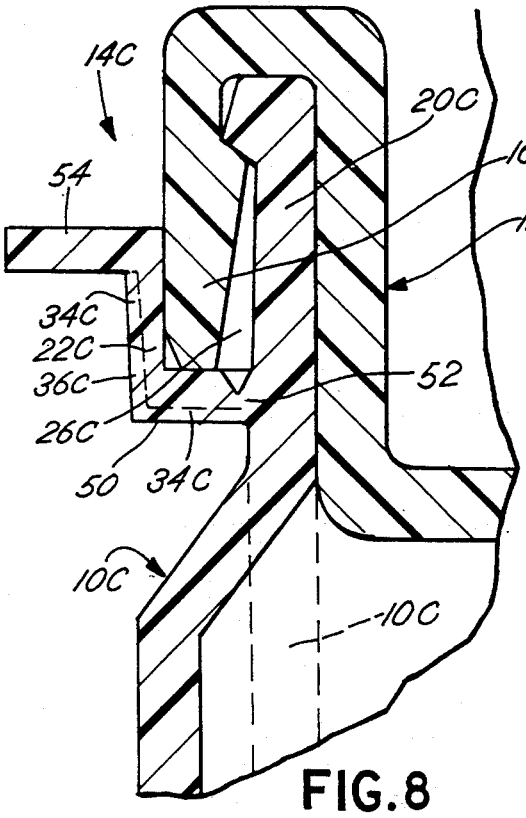
FIG. 8 is an enlarged sectional view taken across the bucket lip of yet another embodiment.

Referring to FIG. 1, a container 10 is shown having closed bottom 11 and a lid 12, with container 10 and lid 12 being of any of the designs shown in the subsequent drawings so that lid 12 is locked in place about the container lip 14.

Referring to FIGS. 2 and 3, an enlarged longitudinal sectional view of container lip 14 and a peripheral portion 16 of lid 12 is shown.

Container lip 14 is connected to a main container wall 18, and comprises a pair of spaced walls 20, 22 surrounding the longitudinal axis 24 of container 10. Container 10 is shown to be of a cylindrical configuration in FIG. 1. However, the container may be rectangular or of another shape if desired.

A recess 26 is defined between sidewalls 20, 22, for receiving and locking the peripheral portion 16 of lid 12, as shown, into a permanent locking arrangement. Lid 12 cannot be practically removed except by the manner described below, which results in clear evidence that such removal has taken place. Specifically, lid periphery 16 is retained by outwardly projecting rib 28, which engages inwardly projecting rib 30 of lid 12. Also, inwardly projecting rib 32 is carried by the outer, spaced wall 22, for further retention of periphery 16 of lid 12.

In accordance with this invention, outer spaced wall 22 defines a pair of spaced points of tearing weakness 34, so that outer wall 22 may be broken with a pair of vertical tear lines, permitting the folding outward of an outer wall section 36 between points 34 by grasping the wall section at the top adjacent rib 32, and forcing it to pivot outwardly as indicated by arrow 38 of FIG. 2. The weakened points 34 are broken in this process, permitting wall section 36 to be pivoted outwardly, thus freeing a portion of lid periphery 16 from its engagement with rib 32. Then, a screw driver may be brought to bear to dislodge periphery 16 from its engagement, to thus remove lid 12.

It can be seen that lid 12 can then be replaced when desired back into its sealing relation with the lip 14 of container 10, to provide a substantial measure of good sealing again. Wall portion 36 can be folded up once again to assist in relocking of the container. However, because of the breaks which have taken place at weakened areas 34, it is not possible to disguise the fact that the container has been once opened.

Referring to FIGS. 4 and 5, another embodiment of the container and lid of this invention is shown, being of similar design and function to the previous embodiment, but for the differences disclosed herein and in the drawings. Container **10*a* defines a lip 14*a* which comprises inner wall 20*a* and outer wall 22*a*, to define a recess 26*a* for receiving a peripheral closure rim 16*a* of a lid 12*a*. An annular inner wall 40 may be provided in lid 12*a* for sealing purposes, as shown. It can be seen that in this embodiment also, lid 12*a* cannot be practically removed from container 10*a*** without the destructive, tamper indicating step in accordance with this invention.

FIG. 5 shows a plan view of outer wall **22*a*, carrying vertical, weakened areas 34*a*** similar to those of the previous embodiment.

Thus, to open this container, one may grasp the outer end of wall **22*a* and projecting rib means 32*a*, and pull it outwardly as shown by the dotted line configuration, rupturing the weakened areas 34*a* to separate a wall section 36*a* having newly-formed, free lateral edges, permitting wall section 36*a*** to be pivoted outwardly as shown in the dotted lines.

Thus, a portion of lid periphery **16*a* is laterally exposed to the exterior, and some of the outer lid edge 42 is no longer in contact with projection 32*a*. Beginning from this access point, one can pry lid 12*a* off with a screw driver or the like to peel it away from its engagement with container 10*a*. Because of the flexibility of the typical plastic which is used, lid 12*a*** can be removed by a peeling action. This same flexibility causes the lid to be very resistant to "pop-off", caused by shock forces created upon dropping of a full container or the like.

Drain holes 43 may be provided below recess **26*a*** if desired.

Referring to FIG. 6, a modified container and lid design from that of FIGS. 4 and 5 is shown, in which lid **12*a* may be identical to the corresponding lid of FIGS. 4 and 5, and the container lip 14*a* may also be identical to the previous design. However, in this embodiment the wall 44 of the container is shifted inwardly with respect to the container of FIG. 4 so that the container lip extends outwardly from wall 44** rather than inwardly therefrom as in the previous embodiment.

Referring to FIG. 7, the lip **14*b* of a modified container 10*b* is shown, with an attached lid 12*b* having a different design of attachment periphery 16*b*. Here also, container 10*b* defines a pair of spaced walls 20*b*, 22*b* to define the recess 26*b* for receiving and locking lid peripheral portion 16*b***.

As in the previous embodiments, the pair of points of tearing weakness **34*b* are provided so that a section 36*b* of outer wall 22*b* may be pulled out, severing vertical lines of weakened portions 34*b*, as shown in the dotted line position of wall 22*b*, to provide access to a screwdriver for dislodging a portion of lid periphery 16*b*** out of its locking position for opening thereof.

Referring to FIGS. 8 through 11, another embodiment of the container and closure system of this invention is shown, being basically shown overall by FIG. 1. Container **10*c* defines a double-walled lip 14*c* which retains and holds a container lid 12*c* in a manner broadly similar to the previous embodiments. Container lip 14*c* defines a pair of spaced walls 20*c*, 22*c* to define the recess 26*c* into which the peripheral portion 16*c* of the lid is locked. It can be seen that, because of the presence of outer peripheral wall 22*c*, the attachment of lid 12*c* to container 10*c*** is effectively permanent, without a destructive, tamper-indicating opening action.

Lines of tearing weakness **34*c* are provided. In this embodiment, lines of tearing weakness 34*c* are of L-shape so that not only can wall portion 36*c* be pivoted outwardly, but a bottom portion 50 may be laterally disconnected from the remainder of container 10*c*, to pivot about pivot line 52, as shown by comparison of FIGS. 8 and 10**.

Tab 54 is provided to facilitate the outward bending of wall **22*c* and bottom wall 50, by tearing the lines of weakness 34*c* to permit such downward bending simply by pressure of a finger on tab 54. Then, the outer periphery 16*c* of lid 12*c* is exposed to permit pulling of periphery 16*c* outwardly to thus peel lid 12*c* off of container 10*c***.

Figure 11:
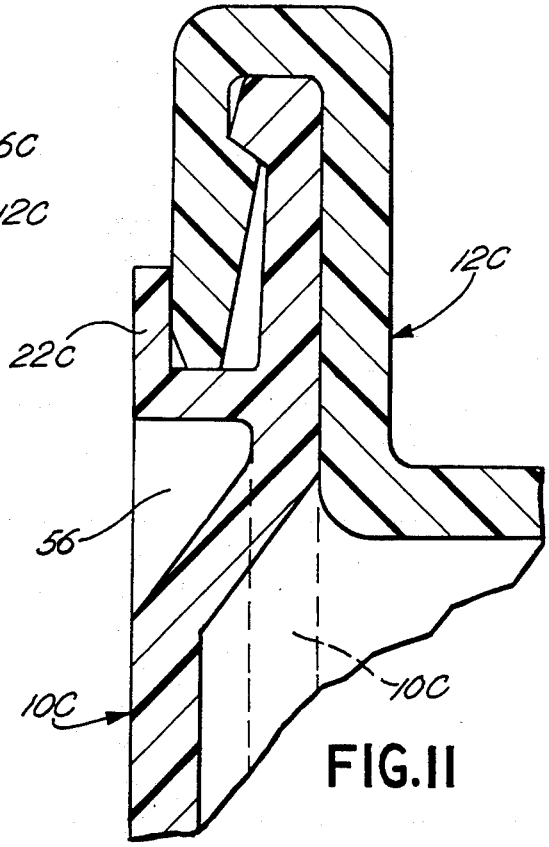
FIG. 11 is a sectional view taken through a portion of the lip of the bucket of FIG. 8, but at a point along the circumference which is spaced from and not bracketed by the points of tearing weakness, showing a portion of the outer wall of the bucket lip which does not fold outwardly.

FIG. 11 shows a portion of container **10*c* in which outer wall 22*c* is outside of the area bounded between the pairs of lines of weakness 34*c*, so that this portion of wall 22*c* does not readily bend outwardly. In fact, it may be reinforced with strengthening vanes 56, if desired. Lid 12*c* may be removed from its engagement with the section of the container shown in FIG. 11** as facilitated by the "peeling" action which results from the semi-flexible nature of both the lid and the container, since they may be constructed of plastic such as polyethylene.

If desired, container 10c may be of a straight-walled type, as shown in dotted lines.

The above has been offered for illustrative purposes only, and is not intended to limit the scope of the invention of this application, which is as defined in the claims below.

That which is claimed is:

1. A plastic container having a top and a bottom and defining a sidewall closed at said bottom and open at said top, a container lip defined at a top of said sidewall and comprising a pair of spaced, annular walls surrounding a longitudinal axis of said container to define an upwardly open recess between said spaced walls for receiving and locking a depending peripheral, annular container lid portion of a container lid on said top of said container, an outwardly extending first locking shoulder at an upper end of an inner one of said spaced walls, and a complementary inwardly extending second locking shoulder adjacent an upper end of said depending peripheral, annular container lid portion whereby when said container lid is forced downwardly on said top of said container to cause said depending peripheral annular lid portion to project down into said upwardly open recess, said first and second locking shoulders interlock to cause said container lid to be locked to said top of said container, and an outer one of said spaced walls being connected to said inner one of said spaced walls by a generally horizontal flange, said outer one of said spaced walls defining at least one pair of spaced points of tearing weakness to permit breaking of said outer one of said spaced walls and outward and downward folding of both a part thereof positioned between said points of tearing weakness and a portion of said horizontal flange to provide access to said peripheral lid portion for lid removal.

2. A plastic container as defined in claim 1 where said pair of spaced walls are approximately parallel to one another.

3. A plastic container as defined in claim 1 where said outer one of said spaced walls surrounds and approximately engages said depending peripheral, annular container lid portion to prevent outward movement of said peripheral annular, container lid portion thereby to hold said lid in locked relation to said top of said container.

4. A plastic container as defined in claim 3 where said outer one of said spaced walls is substantially vertical, an outer portion of said depending peripheral, annular container lid portion is substantially vertical, and said outer one of said spaced walls is in intimate contact with said outer portion of said depending peripheral, annular container lid portion to hold said lid in locked relation to said top of said container.

5. A plastic container as defined in claim 1 where said sidewall of said container is inclined inwardly near its upper end and then extends upwardly to define said inner one of said spaced walls, said generally horizontal annular flange extends outwardly from a lower end of said inner one of said spaced walls and then extends upwardly to define said outer one of said spaced walls, and said outer one of said spaced walls being substantially in vertical alignment with said sidewall of said container.

6. A plastic container as defined in claim 5 where a generally horizontal weakened hinge area is formed along said generally horizontal flange adjacent an inner portion thereof, said hinge area being located between said points of tearing weakness to facilitate outward and downward folding of said part of said outer one of said spaced walls including folding of an integral portion of a part of said horizontal annular flange.

7. A plastic container as defined in claim 1 where said outer one of said spaced walls includes an outwardly projecting tab between said pair of points of tearing weakness for manual gripping of said tab to facilitate said breaking of said outer one of said spaced walls and outward and downward folding thereof.

8. A plastic container having a top and a bottom and defining a sidewall closed at said bottom and open at said top, a container lip defined at a top of said sidewall and comprising a pair of spaced, annular walls surrounding a longitudinal axis of said container to define an upwardly open recess between said spaced walls for receiving and locking a depending peripheral annular container lid portion of a container lid on said top of said container, an outwardly extending first locking shoulder at an upper end of an inner one of said spaced walls, and a complementary inwardly extending second locking shoulder adjacent an upper end of said depending peripheral, annular container lid portion whereby when said container lid is forced downwardly on said top of said container to cause said depending peripheral annular lid portion to project down into said upwardly open recess, said first and second locking shoulders interlock to cause said container lid to be locked to said top of said container, said sidewall of said container being inclined inwardly near its upper end and then extending upwardly to define said inner one of said spaced walls, a generally horizontal annular flange which extends outwardly from a lower end of said inner one of said spaced walls and then extends upwardly to define said outer one of said spaced walls, and said outer one of said spaced walls being substantially in vertical alignment with said sidewall of said container, said outer one of said spaced walls being located to surround and approximately engage said depending peripheral, annular container lid portion to prevent outward movement of said peripheral annular container lid portion thereby to hold said lid in locked relation to said top of said container, and said outer one of said spaced walls defining at least one pair of spaced points of tearing weakness to permit breaking of said outer one of said spaced walls and outward and downward folding of both a part thereof positioned between said points of tearing weakness and a portion of said horizontal flange to provide access to said peripheral lid portion for lid removal.

9. A plastic container as defined in claim 8 where said outer one of said spaced walls includes an outwardly projecting tab between said pair of points of tearing weakness for manual gripping of said tab to facilitate said breaking of said outer one of said spaced walls and outward and downward folding of a part thereof.

10. A plastic container as defined in claim 8 where a generally horizontal weakened hinge area is formed along said generally horizontal flange adjacent an inner portion thereof, said hinge area being located between said points of tearing weakness to facilitate outward and downward folding of said part of said outer one of said spaced walls including folding of an integral portion of a part of said horizontal annular flange.

* * * * *